United States Patent [19]

Walker

[11] Patent Number: 4,727,659

[45] Date of Patent: Mar. 1, 1988

[54] SHOE HEEL PROTECTOR

[76] Inventor: N. Tony Walker, 501 Redwood Dr., Grand Prairie, Tex. 75051

[21] Appl. No.: 942,192

[22] Filed: Dec. 16, 1986

[51] Int. Cl.[4] ..... A43B 23/30; B65D 63/02; A44B 11/22

[52] U.S. Cl. ..... 36/72 B; 36/72 R; 24/177; 24/16 PB; 24/580

[58] Field of Search ..... 36/72 R, 72 B, 7.3; 24/176, 177, 16 BP, 580, 697; 2/311

[56] References Cited

U.S. PATENT DOCUMENTS

| | | | |
|---|---|---|---|
| 1,100,319 | 6/1914 | Moore | 36/7.3 |
| 3,099,054 | 7/1963 | Spiro | 24/16 PB |
| 3,104,479 | 9/1963 | D'Amico | 36/72 B |
| 3,187,446 | 6/1965 | Bordemann | 36/72 B |
| 3,654,049 | 4/1972 | Ausmt | 24/16 PB |
| 3,851,412 | 1/1974 | Voegele et al. | 36/72 B |
| 3,983,641 | 8/1975 | Wright | 36/72 B |
| 4,249,321 | 9/1979 | Nagy | 36/72 B |
| 4,459,764 | 4/1983 | Beck | 36/72 B |
| 4,577,418 | 11/1983 | Nagy | 36/72 B |
| 4,578,843 | 4/1986 | Lewis | 24/580 |

FOREIGN PATENT DOCUMENTS

| | | | |
|---|---|---|---|
| 3140289 | 4/1983 | Fed. Rep. of Germany | 36/72 B |
| 1263055 | 4/1961 | France | 36/72 B |
| 65239 | 12/1926 | Sweden | 24/580 |
| 2118427 | 11/1983 | United Kingdom | 36/72 B |
| 2142813 | 1/1985 | United Kingdom | 36/72 B |

*Primary Examiner*—Steven N. Meyers

*Attorney, Agent, or Firm*—Hubbard, Thurman, Turner & Tucker

[57] ABSTRACT

A shoe heel protection apparatus. A base underlies the heel and instep portion of a shoe and has side walls 16 formed contiguous therwith. The side walls extend generally upwardly from the base to cover and protect the sides and heel portion of the shoe from scuffing. A unique strap means is formed contiguous with the side walls and engages over the instep of the shoe. A pin strap and socket strap interlock by manually engaging the pin members of the pin strap with the apertures formed in section plates of the socket strap. The strap means may be easily adjusted to accommodate differing shoe sizes by selection of a particular one of the section plates for engagement with the pin members of the pin strap. The apparatus is of a light weight molded plastic construction and is injection molded as a unitary piece.

14 Claims, 4 Drawing Figures

SHOE HEEL PROTECTOR

BACKGROUND OF THE INVENTION

The present invention relates generally to shoe heel protectors for protecting the heel portion of a shoe from scuffing, and more particularly provides a unique shoe heel protection apparatus which interlocks over the user's instep.

The wide variety of styles and designs for both men and women's shoes commonly provide a downwardly extending heel portion for contact with the ground, floor or other surface. The upper portion of the shoe heel, however, is usually constructed of finished material designed for aesthetics and is not well suited for contact with rough surfaces. A common problem associated with the destruction of the cosmetic appearance of a shoe occurs while driving a motor vehicle. During the normal course of driving, foot motion is required which differs significantly from the usual act of walking for which a shoe is designed. The foot must be precariously balanced about the edge of the heel to permit flexing of the ankle for control of the accelerator, clutch and brake pedals. The upper portion of the shoe heel has a tendency to rub against the floorboard of the car, thereby scuffing the heel of the shoe and detracting from its cosmetic appearance. This problem is also prevalent in automobiles having floorboards covered with plush carpet, since grit and other material become embedded therein and act as an abrasive against the upper heel surface of the operator's shoe.

Various attempts have been previously made to protect the upper heel portion of the average shoe. For example, varieties of cup means have been provided to engage and cover the heel portion of the operator's shoe. However, most such devices incorporate some form of elaborate strap means to secure the apparatus around the user's foot. For example, many devices incorporate metal clasps or velcro TM fasteners to adjustably secure the apparatus to the wearer's shoe. These fastening means require a secondary step in manufacturing which often must be completed by hand. This adds to the ultimate cost of the apparatus and additionally makes it more susceptible to disassembly and failure during use. Unfortunately, most available strap means are impractical, costly to manufacture, and have therefore not gained any significant use.

It is accordingly an object of the present invention to provide an improved shoe heel protector which may be inexpensively manufactured and easily secured about the operator's shoe heel.

SUMMARY OF THE INVENTION

In carrying out the principles of the present invention, in accordance with a preferred embodiment thereof, an improved shoe heel apparatus is provided for protection of a motor vehicle operator's shoe from scuffing. The apparatus is constructed of a single piece of lightweight molded plastic and includes a base positionable beneath the heel and instep of the average shoe. Side walls formed contiguous with the base extend generally upwardly therefrom to cover the sides and upper heel portion of the shoe. The upper edges of the side walls conform to the rim of the average shoe and terminate about the user's ankle region. Strap means formed contiguous with the side walls extend therefrom over the instep of the shoe, and engage to secure the apparatus to the user's foot.

The unique strap means of the present invention include a pin strap and socket strap which meet in a non-overlappng manner to interconnect over the instep of the user's shoe. The pin strap includes a generally enlarged head region having a flat surface at its distal end with a plurality of pin members extending generally longitudinally therefrom. The socket strap is formed of section plates along its length each corresponding generally to the dimensions of the flat surface at the distal end of the pin strap, and each having apertures to correspond to the pin members of the pin strap. The section plates are separated by recessed notches which permit folding of the section plates to orient a single desired section plate at the distal end of the socket strap, thereby adjusting the length thereof. The selected section plate is thus oriented parallel to the flat surface of the pin strap to permit engagement of the pin members with the apertures formed within the selected section plate. The section plates are held in place by a loop member. Enlarged heads formed on the distal ends of the pin members are of a diameter slightly larger than that of the apertures of the socket strap, such that the pin members must be forcibly engaged with the apertures to secure the strap means. Finger grips are provided along the side of the pin strap head to facilitate manual engagement and detachment of the pin members with the apertures of the socket strap.

According to another feature of the present invention, corrugated ribs are formed on the heel area and side walls of the apparatus. The corrugated ribs prevent the apparatus from slipping inordinately along the floorboard of an automobile during use of the control pedals. The corrugated ribs prevent the unexpected hazard of the operator's foot slipping away from the control pedals due to the slick nature of the plastic material forming the side walls of the apparatus resting against the often slippery plush carpeting of the motor vehicle floorboard.

In accordance with another feature of the present invention, the base of the apparatus may include a cavity through with the operator's shoe heel may extend. This cavity is necessary for use of the apparatus in conjunction with some types of women's shoes which have extended heels. The apparatus may therefore be used in conjunction with both men and women's shoes, and may also be constructed in different sizes as necessary.

During normal operation of the unique shoe heel apparatus of the present invention, the operator grasps the apparatus by a tongue member generally extending from the upper back portion of the side walls to pull the apparatus over the shoe. The strap means is then adjusted by orienting a particular one of the section plates at the distal end of the socket strap, and is secured in place by the retaining loop. The head of the pin strap is grasped at the finger grip surfaces and the pin members thereon are forcible engaged with the apertures of the distal section plate of the socket strap. The device is thereby secured to the user's foot to prevent the cosmetic areas of the side and upper heel portion of the shoe from becoming scuffed.

DETAILED DESCRIPTION

Figure 1:
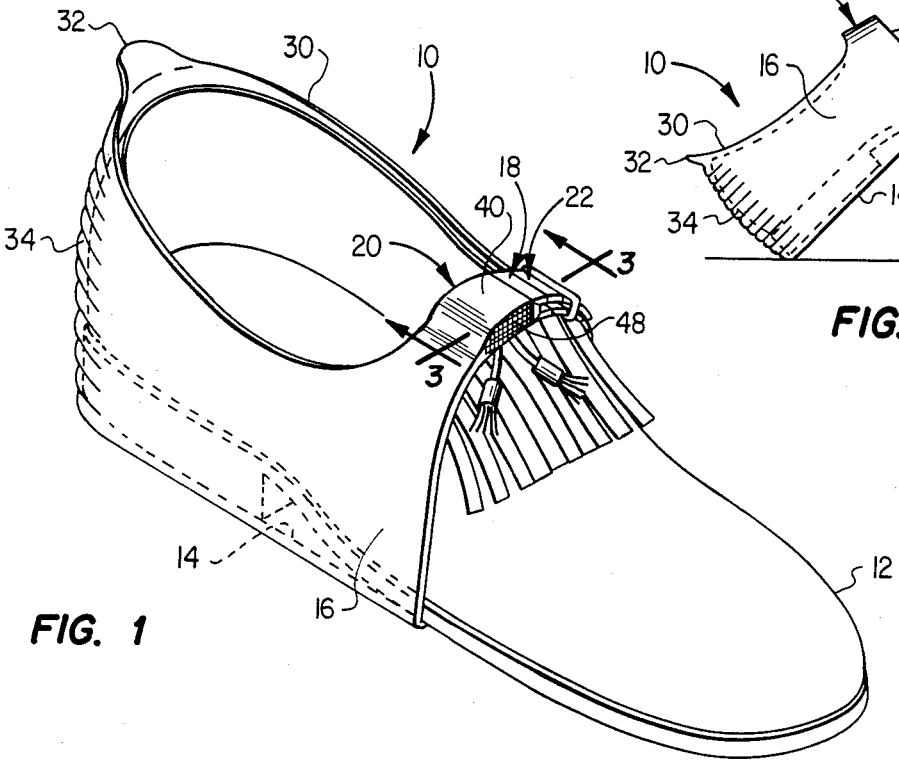
FIG. 1 is a perspective view of a shoe heel apparatus embodying principles of the present invention secured about a standard shoe for protection of the heel area from scuffing.

Perspectively illustrated in FIG. 1 is the shoe heel apparatus 10 of the present invention secured over a standard shoe 12. A base 14 underlies the heel and instep portion of the shoe 12 and has side walls 16 formed contiguous therewith. The side walls 16 extend generally upwardly from the base 14 to cover and protect the sides and heel portion of shoe 12 from scuffing.

The present invention provides the shoe heel apparatus 10 with a unique strap means 18 which is formed contiguous with side walls 16 and engages over the instep of shoe 12. As will be subsequently described, a non-overlapping pin strap 20 and socket strap 22 interlock by manually engaging the pin members 24 of pin strap 20 with the apertures 26 formed in section plates 28 of socket strap 22. As will be seen, strap means 18 may be easily adjusted to accommodate differing shoe sizes by selection of a particular one of section plates 28 for enegagement.

Figure 4:
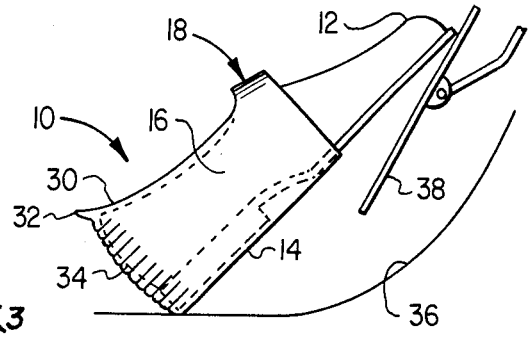
FIG. 4 is a reduced, side elevational view of the shoe heel apparatus of the present invention illustrating the apparatus as worn by the operator of a motor vehicle.
Figure 2:
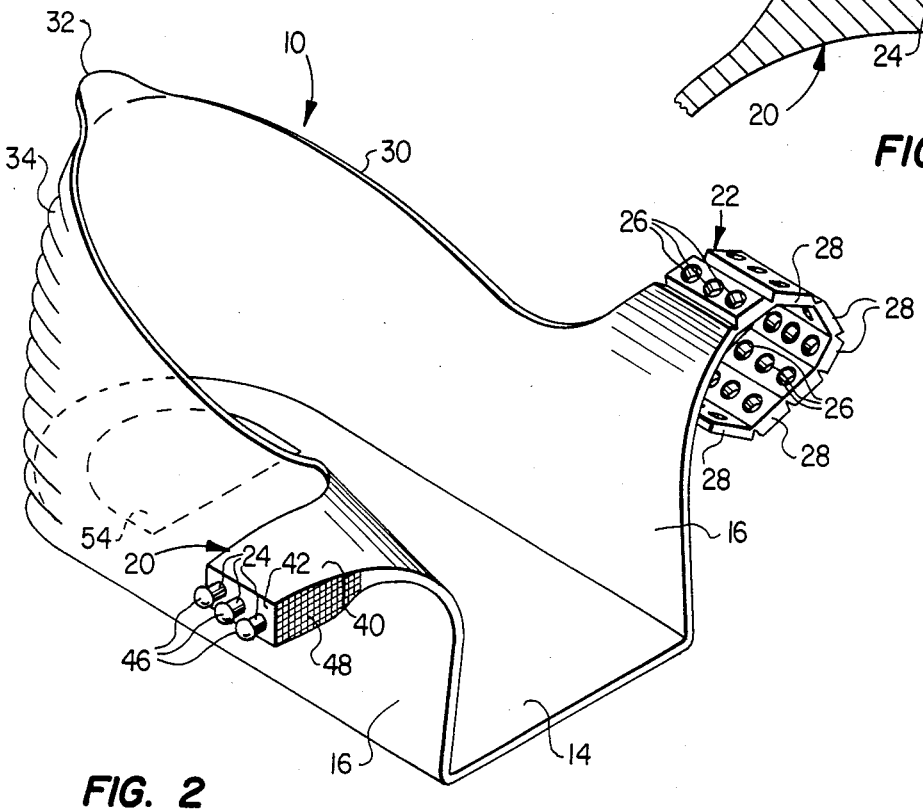
FIG. 2 is an enlarged perspective view of the shoe heel apparatus of FIG. 1 showing the strap means in a disengaged position.

Referring to FIGS. 2 and 4, apparatus 10 is of a light weight molded plastic construction and in particular may be injection molded as a unitary piece. Base 14 is of suitable dimensions to underlie the heel and instep portion of shoe 12. Side walls 16 extending generally upward from base 14 to cover the upper heel portion and sides of shoe 12 for protection thereof, and are trimmed along an upper edge 30 to meet generally with the top rim of shoe 12 about the user's ankle. A tongue member 32 extends outwardly along a back portion of upper edge 30 and provides a gripping surface for the user to pull apparatus 10 over shoe 12 into position for use. Side walls 16 also incorporate corrugated ribs 34. Ribs 34 prevent the user's foot from slipping along the surface of floorboard 36 of a motor vehicle during crucial operation functions. This safety feature is particularly important in newer automobiles having plush carpet lining the floorboard 36, since the slick surface of the plastic material forming side walls 16 does not have the same coefficient of sliding friction as the normal shoe heel and may disorient the user in managing the motor vehicle pedals 38.

Figure 3:
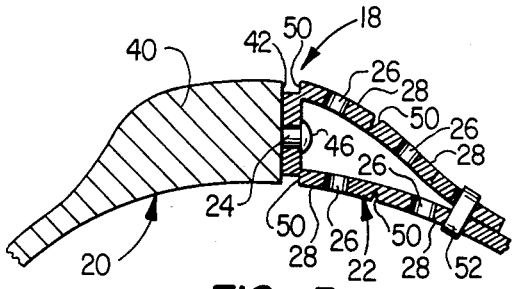
FIG. 3 is a cross-sectional, cutaway view through the strap means, taken along line 3—3 of FIG. 1, and illustrates the engagement of the pin strap and socket strap.

Referring now to FIGS. 2 and 3, strap means 18 is formed contiguous with side walls 16 and includes a pin strap 20 and socket strap 22 extending respectively from each of side walls 16 to engage over the instep of shoe 12. Pin strap 20 deviates from the otherwise uniform thickness of the plastic material forming apparatus 10 and has elevated sides to form a pin strap head 40. At the distal end thereof lies flat surface 42 having dimensions generally corresponding to each of section plates 28. Extending generally longitudinally from pin strap 20 and perpendicular to flat surface 42 are a plurality of pin members 24. Pin members 24 insert into corresponding apertures 26 to secure strap means 18. In the preferred embodiment, three pin members are disposed along flat surface 42 to correspond with the three apertures 26 formed within each section plate 28. However, a single pin, or other multiple combinations of pin members 24 and apertures 26, may be contemplated. Each pin member 24 includes an enlarged head 46 having a diameter slightly larger than that of apertures 26. Thus, pin member 24 must be forced through aperture 26 and will be retained therein, thereby securing strap means 18, unless an equal force is applied to separate pin member 24 and aperture 26 for disengagement. Pin strap 20 further includes finger grip surfaces 48 along the sides of pin strap head 40 to facilitate the user in manually forcing pin members 24 into apertures 26 for engagement or in separating them during disengagement. Finger grip surfaces 48 are also corrugated to provide an enhanced grip thereof.

Socket strap 22 extending from side wall 16 includes multiple section plates 28 forming the length thereof. Apertures 26 are formed in each section plate 28 to correspond to pin members 24. Section plates 28 are of the same uniform thickness of the plastic material of apparatus 10 and are separated by notches 50 forming area of lesser thickness and increased pliability. This permits section plates 28 to be folded back such that any one section plate 28 may be oriented parallel to flat surface 42 of pin strap 20 and form the distal end 42 of socket strap 22. This allows the user to easily adjust the length of the strap by selecting which section plate 28 is to form the distal end of socket strap 22 and engage with pin strap 20. Section plates 28 are retained in the desired position by sliding loop 52 which holds the remaining section plates 28 together. The selected section plate 28 oriented parallel to flat surface 42 and forming the distal end of socket strap 22 is engaged with pin members 24 of pin strap 20 as the user grasps finger surfaces 48 and forces enlarged heads 46 through apertures 26. Strap means 18 may repeatedly and easily be engaged or disengaged as desired by the user.

It is contemplated that the dimensions of apparatus 10 are suitable for use with any size shoe 12, and likewise may be used with either men's or women's shoes. In an alternative embodiment for use with women's shoes, cavity 54 is formed within base 14 to permit a portion of the shoe heel to extend therethrough. Cavity 54 is necessary for use with ladies shoes having extended or high heels. The apparatus 10 may also be constructed in various sizes and of various materials according to consumer demand. The unitary formation of apparatus 10 by injection molding represents a significant departure from currently available shoe heel devices which require multiple manufacturing steps adding to the cost of production.

The foregoing detailed description is to be clearly understood as being given by way of illustration and example only, spirit and scope of the present invention being limited solely by the appended claims.

What is claimed is:

1. A shoe heel apparatus for engaging the rear portion of a shoe, comprising:

a base positionable beneath the heel and instep of the shoe;

side walls formed contiguous with said base and extending generally upwardly therefrom to cover the sides and upper heel portion of the shoe;

strap means formed contiguous with said side walls and extending therefrom to selectively engage over the instep of the shoe, said strap means comprising a pin strap and socket strap which selectively interlock at their distal ends, said socket strap including a plurality of section plates having a plurality of apertures formed therein such that a selected one of said section plates may be positioned to form the distal end of said socket strap for engagement with said pin strap, thereby selectively adjusting the length of said socket strap.

2. The apparatus according to claim 1 wherein:

said selected one of said section plates is secured in position by a retaining loop which holds the remaining section plates in place.

3. The apparatus according to claim 1 wherein:

said pin strap includes a plurality of pin members protruding longitudinally from the distal end thereof for insertion into corresponding apertures formed within said selected one of said section plates to selectively interlock said pin strap and said socket strap.

4. The apparatus according to claim 3 wherein:

the distal end of each said pin member includes an enlarged head which must be forcibly inserted through or retracted from said apertures to ensure a secure interlock of said pin strap and socket strap.

5. The apparatus according to claim 1 wherein:

said pin strap includes elevated side walls forming finger grips for handling said pin strap.

6. The apparatus according to claim 1 wherein:

said base includes a cavity to permit a portion of the shoe heel to extend generally downwardly therethrough.

7. The apparatus according to claim 1 wherein:

said side walls are formed having selected corrugated rib surfaces.

8. The apparatus according to claim 1 wherein:

a rear portion of said side walls includes a tongue at upper edge for manually gripping said apparatus and facilitating placement over the shoe.

9. The apparatus according to claim 1 wherein:

said apparatus is formed as a unitary piece of molded plastic.

10. A shoe heel apparatus for engaging the rear portion of a shoe, comprising:

a base positionable beneath the heel and instep of the shoe;

side walls formed contiguous with said base and extending generally upwardly therefrom to cover the sides and upper heel portion of the shoe;

strap means formed contiguous with said side walls and extending therefrom to manually engage over the instep of the shoe by interlocking the distal ends thereof, said strap means comprising a pin strap and socket strap and including a plurality of section plates having apertures formed therein such that a selected one of said section plates is positionable to form the distal end of said socket strap for engagement with said pin strap, thereby selectively adjusting the length of said socket strap, said pin strap having a plurality of pin members extending longitudinally from the distal end thereof for engagement with said selected one of said section plates.

11. The apparatus according to claim 10 wherein:

said socket strap includes a security loop slideably engageable with said section plates to retain said section plates in the selected position.

12. The apparatus according to claim 10 wherein:

said side walls are corrugated.

13. The apparatus according to claim 10 further including:

a tongue member forming an upper edge of a rear portion of said side walls for manually pulling said apparatus in place about the shoe.

14. The apparatus according to claim 10 wherein:

said base includes a cavity to permit a portion of the shoe heel to extend therethrough.

* * * * *